US007322482B2

(12) United States Patent
Caradonna

(10) Patent No.: US 7,322,482 B2
(45) Date of Patent: Jan. 29, 2008

(54) CLIP FOR SUPPORTING WINE BOTTLES OR THE LIKE

(75) Inventor: Anthony Caradonna, New York, NY (US)

(73) Assignee: AC² Studio, Inc., New York, NY (US)

( * ) Notice: Subject to any disclaimer, the term of this patent is extended or adjusted under 35 U.S.C. 154(b) by 199 days.

(21) Appl. No.: 11/041,600

(22) Filed: Jan. 25, 2005

(65) Prior Publication Data

US 2006/0163181 A1 Jul. 27, 2006

(51) Int. Cl.
*A47B 73/00* (2006.01)

(52) U.S. Cl. ..... 211/74; 211/75; 248/214; 248/215; 248/303

(58) Field of Classification Search ..... 248/312.1, 248/228.7, 231.81, 214, 215, 102–107, 303; 211/73, 74, 85.31; D7/701, 707, 704; 24/369, 24/370, 457

See application file for complete search history.

(56) References Cited

U.S. PATENT DOCUMENTS

| | | | | | |
|---|---|---|---|---|---|
| 451,097 | A | * | 4/1891 | Wilkinson | 211/74 |
| 2,527,713 | A | * | 10/1950 | Dunn | 248/214 |
| 2,607,554 | A | * | 8/1952 | Charipar | 248/312 |
| 2,636,704 | A | | 4/1953 | Norberg | |
| 2,711,873 | A | * | 6/1955 | Larin | 248/215 |
| 2,763,377 | A | * | 9/1956 | Martin | 211/73 |
| 4,004,687 | A | * | 1/1977 | Boone | 206/233 |
| D701,902 | | | 10/1987 | Heitz | |
| 4,809,894 | A | | 3/1989 | Viio | |
| 4,887,726 | A | * | 12/1989 | Cizaire | 211/74 |
| D329,781 | S | | 9/1992 | Ito | |
| 5,180,066 | A | | 1/1993 | Mc Ardle | |
| 5,558,236 | A | | 9/1996 | Williams | |
| 5,573,123 | A | | 11/1996 | La Londe | |
| 5,624,043 | A | | 4/1997 | Baptista | |
| D396,783 | S | | 8/1998 | Lee | |
| D409,056 | S | | 5/1999 | Olson | |
| 6,209,733 | B1 | | 4/2001 | Higgins | |
| 6,230,905 | B1 | | 5/2001 | Camblor | |
| 6,234,326 | B1 | | 5/2001 | Higgins | |

FOREIGN PATENT DOCUMENTS

GB 2123681 A * 2/1984

* cited by examiner

*Primary Examiner*—Gwendolyn Baxter
(74) *Attorney, Agent, or Firm*—Harold James; Epstein Drangel Bazerman & James

(57) ABSTRACT

A clip adapted to be mounted on a support such as a conventional pot rack holds a long-necked bottle, such as a wine bottle, in display position with the tip of the bottle neck engaging the lower edge of the support and with the clip engaging a portion of the bottle neck spaced from the tip.

6 Claims, 1 Drawing Sheet

CLIP FOR SUPPORTING WINE BOTTLES OR THE LIKE

This invention relates to a clip for supporting a bottle such as a wine bottle in an accessible exposed display condition extending from a support such as a conventional pot holder which is often readily available in a kitchen.

BACKGROUND OF THE INVENTION

It is often desired to support bottles, and particularly wine bottles, for display and use, and there have been many structures designed to perform that functions. Some are self-supporting, while others are adaptedly to be secured to external supports such as walls. Such structures take up appreciable floor or wall space and most are useable only in areas not dedicated to other uses, for example, storage spaces such as wine rooms or display areas such as floors or walls of wine shops. They are however not particularly well adapted for use in areas such as kitchens not dedicated to wines, despite the fact that wines, and particularly an assortment of wines, are appropriate, and even required, while practicing the culinary arts.

SUMMARY OF THE INVENTION

A chef, commercial or domestic, may want to have one or more wine bottles available for use as dictated by the particular dish in the course of preparation. Space in a kitchen is usually at a premium, and providing previously available wine bottle supports in areas also needed for other purposes would detract from the efficient use of space. There is accordingly a need for a device which, when the availability of one or more wine bottles is called for, effectively supports such bottles so that they are readily available to the chef for selection and use without meaningfully interfering with other space consuming devices, but which when the availability of wine bottles is not required may be stored away so as to take up no space at all in the kitchen.

The normal kitchen is provided with wall mounted supports normally used for purposes far removed from wine bottle display. For example, standard pot racks are defined by bars or strips generally two inches or so in height which are mounted on the wall and have parts from which pots may be hung. When the chef is working he will often be using one or more pots removed from the pot rack, thus leaving portions of the pot rack available for other use, but even if all of the pots are on the pot rack there are exposed spaces along the length of the pot rack which are not directly in use.

The clip of the present invention is designed to make use of existing kitchen supports such as pot racks to hold wine bottles in exposed conditions for display and removal for use by the chef when needed. To that end a clip fits over the top edge of the pot rack bar or other support and has a portion extending forwardly and downwardly from that top edge to a point below the bottom edge of the bar where it is provided with an opening through which the neck of a wine bottle may pass. The tip of the wine bottle neck extends rearwardly from that opening so as to pass beneath and engage the lower edge of the pot rack bar. The bottle, when thus arranged, will be reliably held in exposed position, from which it can be readily removed and used and then reinserted. The clip is preferably formed of a continuous length of wire, so that it is structurally sound, attractive, relatively inexpensive, and readily storable without taking up any appreciable space when it is not in use.

BRIEF DESCRIPTION OF THE DRAWINGS

To the accomplishment of the above, and to such other objects as may hereinafter appear, the present invention relates to a bottle-supporting clip designed for use with an otherwise available support such as a pot rack bar, as described in this specification and as disclosed in the accompanying drawings, in which.

DETAILED DESCRIPTION OF THE PREFERRED EMBODIMENT

Figure 1:
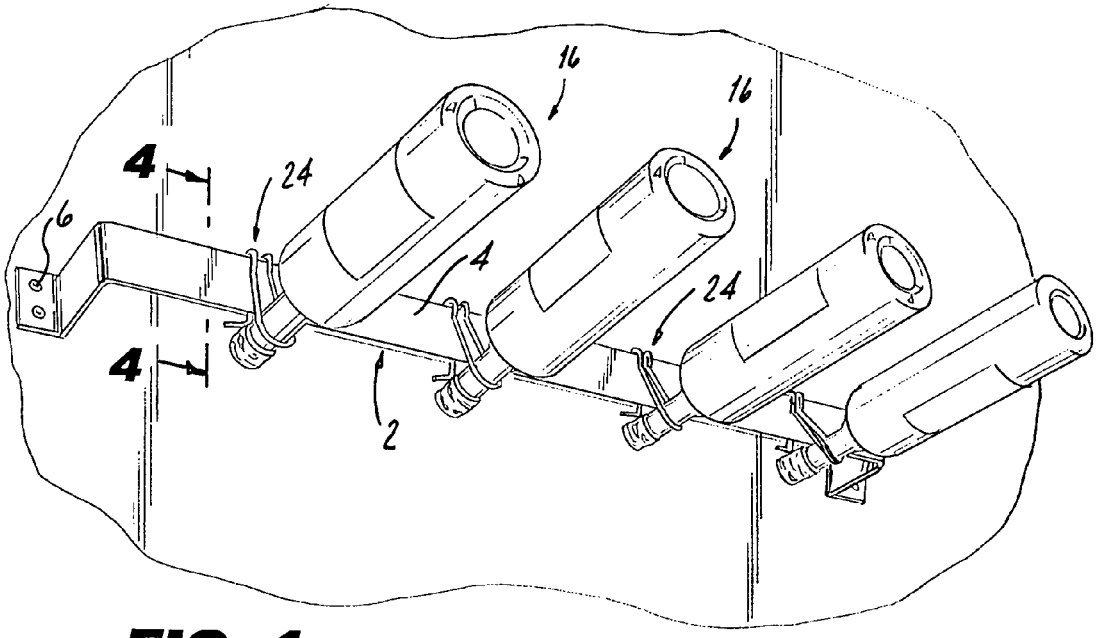
FIG. 1 is a three-quarter perspective view showing a group of wine bottles mounted on a standard pot rack bar by clips of the present intention.
Figure 2:
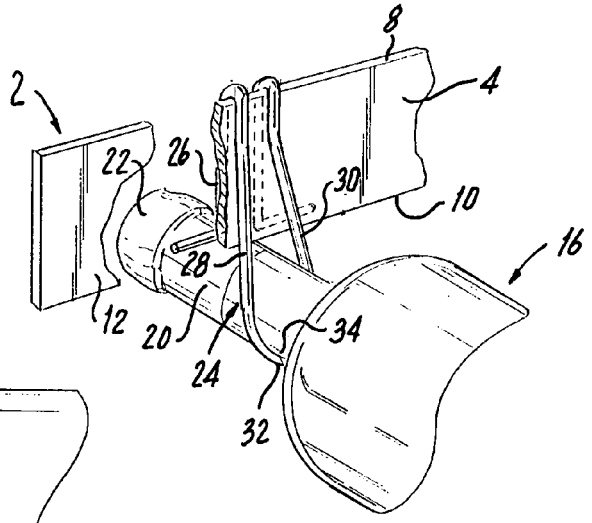
FIG. 2 is a perspective diagrammatical view of a clip of the present invention in place on a pot rack bar.
Figure 3:
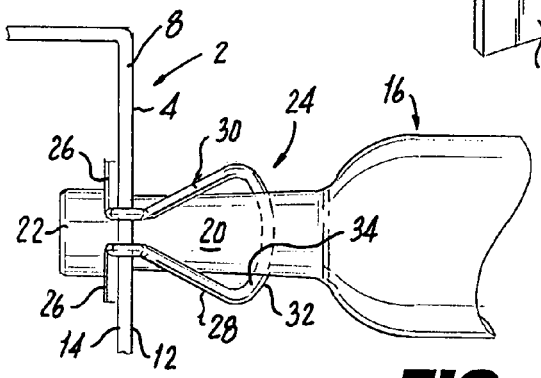
FIG. 3 is a top plan view of a bottle mounted on a support by means of the clip of the present invention.
Figure 4:
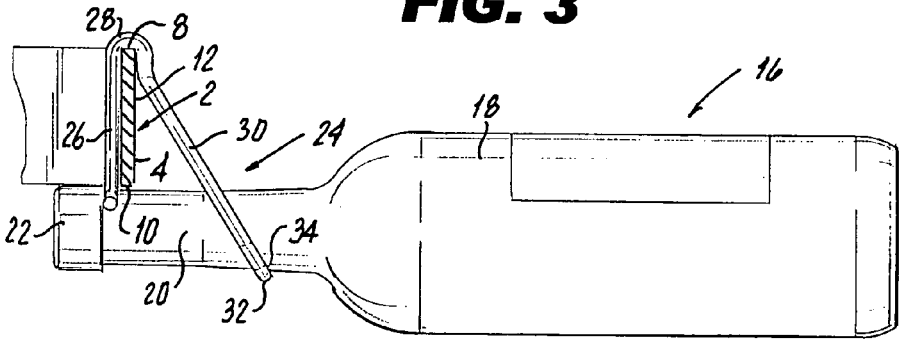
FIG. 4 is a side elevational view thereof.

Typical of the normally kitchen-available supporting members, generally designated 2, is the horizontally extending bar 4 of a conventional pot rack adapted to be secured to a wall by means of supporting flanges 6. The bar 4 has an upper edge 8 and a lower edge 10 separated therefrom by a short distance, usually about two inches, and it has a front surface 12 and a rear surface 14. A long-necked bottle such as a wine bottle generally designated 16 has a body 18 and an elongated neck 20 which extends to the tip 22.

The clip of the present invention, here generally designated 24, comprises a first generally vertical portion or leg 26 which leads to a second reverse bent portion 28 so that the clip 24 may be hooked over the upper surface 6 of the support 4. A third portion 30 of the clip 24 extends downwardly and forwardly from the reverse bent portion 28 to a tip 32 which is vertically well below the first clip portion 26 and, as indicated, well below the lower surface 10 of the support 4 when the clip is placed in position on the support 4. The tip 32 of the portion 30 has an opening 34 through which the neck 20 of the bottle 16 may freely pass. In its preferred form, and as here specifically illustrated, the clip 24 is formed of a continuous length of material constructed sequentially by a vertical portion or leg 26, a reverse bent portion 28, a loop defining the third portion 30, another reverse bent portion 28 adjacent to the first portion 26, and another vertical leg 26 adjacent to the first leg 26.

When it is desirable to have a wine bottle available the clip 24 is taken from its storage place in the kitchen such as a drawer and is hooked over the bar 4 at some exposed length thereof with the legs 26 at the rear of the bar 4 and with the third portion 30 of the clip extending out from the wall on which the bar 4 is mounted. The wine bottle 16 is then inserted into the clip 24 by passing the neck 20 of the bottle tip 22 through the opening 34 to a position with the bottle tip below and in engagement with the lower edge 10 of the bar 4. The bottle will then be supported by the clip in a generally horizontal position extending out from the bar 4 and the wall on which the bar 4 is mounted. The bottle 16 is thus readily available for use and displayed in a manner such that the nature and type of its contents is visually apparent, which is particularly desirable when, for example, a red wine is needed for one dish and a white wine is needed for another dish. To remove a bottle from the clip the extending body 18 of the bottle is grasped, it is lifted to disengage the neck tip 22 from the lower edge 10 of the bar 4, and the bottle is then pulled out of the clip 24. These operations are reversed to re-mount the bottle 16 on the bar 4.

Thus the clip of the present invention can utilize the most common and least expensive storage and display system in the commercial and domestic kitchen, to wit, the wall mounted or supported metal pot rack, for displaying wine bottles of choice in the kitchen for ready use and replacement. The bottle fits tightly between the bottom of the pot rack bar 4 or other horizontal support and the inner surface of the clip, balancing the bottle and fixing it into its optimal exposed cantilevered position. Use of the clip of the present invention is economical of money and space, displaying wine bottles in full view and close at hand in clean horizontal rows.

While I have referred here to the use of the clip to support a wine bottle, it will be apparent that that is by way of example only, and that the clip of the present invention can be used to mount any type of container having an elongated "neck" capable of fitting through the opening 34 in the clip. Also, formation of the clip from a continuous length of material, while highly preferred for economic and aesthetic reasons, is not the only way of making the clip.

It will be apparent that many other variations from the single embodiment of the present invention here specifically disclosed may be made, all within the scope of the present invention as defined in the following claims.

I claim:

1. In combination, a bottle holder, a bottle and a support for said bottle and bottle holder, said support having a front and rear surface and having top and bottom edges separated from one another by a given distance, said holder comprising first means for engaging said support over the top edge of said support and at the rear surface of said support and second means inclined forwardly and extending downwardly from said first means by a distance greater then said given distance and there having an opening into which the neck of a bottle is received, said bottle neck passing through said opening and extending under and engaging the bottom edge of said support, thereby to retain said bottle in position.

2. The holder of claim 1 which is formed of a continuous length of material.

3. In combination, a bottle holder, a bottle and a support for said bottle and bottle holder, said support having a top edge and a bottom edge separated from one another by a given distance, said holder comprising a first portion extending behind said support, a second portion extending from said first portion over the top edge of said support and a third portion extending from said second portion in a downwardly and forwardly inclined fashion to a point below said second portion by a distance exceeding said given distance and there having an opening through which a bottle neck can pass the bottle neck passes, whereby a bottle may be held by said holder with its neck passing through said opening and extending under said support in engagement with the bottom edge of said support.

4. The holder of claim 3 which is formed of a continuous length of material.

5. The holder of claim 3 which is formed of a continuous length of material, said third portion comprising a loop of said material having first and second ends, said second portion comprising first and second extensions from said first and second ends respectively, and said first portion comprises a third extension from at least one of said first and second extension.

6. The holder of claim 3 which is formed of a continuous length of material, said third portion comprising a loop of said material having first and second ends and said second portion comprising first and second extensions from said first and second ends respectively, and said first portion comprises a third extension from said first and second extensions respectively.

* * * * *